US009216582B2

(12) United States Patent
Akahane

(10) Patent No.: US 9,216,582 B2
(45) Date of Patent: Dec. 22, 2015

(54) LIQUID EJECTING APPARATUS

(75) Inventor: Takashi Akahane, Miyada (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 12/939,134

(22) Filed: Nov. 3, 2010

(65) Prior Publication Data

US 2011/0102501 A1 May 5, 2011

(30) Foreign Application Priority Data

Nov. 4, 2009 (JP) ..... 2009-252712
Oct. 26, 2010 (JP) ..... 2010-239332

(51) Int. Cl.
*B41J 2/165* (2006.01)
*B41J 11/04* (2006.01)

(52) U.S. Cl.
CPC ..... *B41J 2/16585* (2013.01); *B41J 2/16526* (2013.01); *B41J 11/04* (2013.01)

(58) Field of Classification Search
None
See application file for complete search history.

(56) References Cited

U.S. PATENT DOCUMENTS 4,857,943 A 8/1989 Yoshimura et al.
6,198,492 B1 * 3/2001 Wakahara et al. ..... 347/141
2003/0218652 A1 * 11/2003 Nakashima ..... 347/31
2004/0174408 A1 * 9/2004 Johnson ..... 347/22
2008/0238993 A1 10/2008 Gomez et al.

FOREIGN PATENT DOCUMENTS

| | | | |
|---|---|---|---|
| JP | 2575349 | B | 1/1997 |
| JP | 2003-011377 | A | 1/2003 |
| JP | 2003-285433 | A | 10/2003 |
| JP | 2003-534165 | A | 11/2003 |
| JP | 2003-341158 | A | 12/2003 |
| JP | 2005-067052 | A | 3/2005 |
| JP | 2006-159489 | A | 6/2006 |
| JP | 2009-029020 | A | 2/2009 |
| WO | 01/89836 | A1 | 11/2001 |

* cited by examiner

*Primary Examiner* — Alejandro Valencia
(74) *Attorney, Agent, or Firm* — Kilpatrick Townsend & Stockton LLP

(57) ABSTRACT

A liquid ejecting apparatus includes a liquid ejecting head ejecting liquid from nozzles thereof formed on a nozzle formation surface onto a target that is being transported; and a rotating member rotatably disposed opposite the nozzle formation surface, the rotating member having a supporting surface for supporting the target and an absorbing surface for absorbing the liquid ejected from the nozzle. The rotating member has such a configuration that a first maximum length from a rotational center to the absorbing surface is longer than a second maximum length from the rotational center to the supporting surface.

8 Claims, 5 Drawing Sheets

LIQUID EJECTING APPARATUS

This application claims priority to Japanese Patent Application No. 2009-252712, filed Nov. 4, 2009 and to Japanese Patent Application No. 2010-239332, filed Oct. 26, 2010, the entireties of which are incorporated by reference herein.

BACKGROUND

1. Technical Field

The present invention relates to a liquid ejecting apparatus, such as an ink jet printer.

2. Related Art

In general, ink jet printers (hereinafter referred to as "printers") are widely known as liquid ejecting apparatuses which eject liquid from a liquid ejecting head thereof. Such printers perform printing operations by supplying ink to a recording head (liquid ejecting head) from ink cartridges accommodating ink (liquid), and then by ejecting the ink onto recording media (targets) from nozzles formed on a nozzle formation surface.

Such printers perform flushing operations as appropriate, which discharge ink from all nozzles not for the purpose of printing, in order to reduce the risk of dehydration and clogging of the ink in the nozzles during or not during printing. Flushing is usually performed in the non-printing area of the printer, where no printing is performed. However, in the case of line head printers, the recording heads of which are in a fixed position, flushing is performed in the printing area.

An example of a known line head printer which performs its flushing operation in the printing area is that according to JP-A-2003-341158. The printer according to JP-A-2003-341158 has a platen member (rotating member) disposed so as to rotate about the central axis, the platen member including an ink absorbing surface (absorbing surface) and a recording medium supporting surface (supporting surface).

In printing operations, the platen member functions as a supporting member for recording media (targets), that is, the platen member is turned to cause the recording medium supporting surface thereof to face ink discharging ports (nozzles) of a line head (recording head). Meanwhile, in non-printing operations, the platen member functions as an absorbing member for flushing ink, that is, the platen member is turned to cause the ink absorbing surface thereof to face the ink discharging ports of the line head.

In the printer according to JP-A-2003-341158, the length from the central axis to the ink absorbing surface of the platen member is shorter than that from the central axis to the recording medium supporting surface. Therefore, the distance from the line head to the ink absorbing surface (FIG. 4B in JP-A-2003-341158) is greater than that from the line head to the recording medium (FIG. 4A in JP-A-2003-341158). Such design of the printer is problematic because the ink discharged from the discharging ports during flushing may scatter as mist and foul the inside of the printer.

SUMMARY

An advantage of some aspects of the invention is to provide a liquid ejecting apparatus that can reduce scattering of liquid discharged from nozzles during flushing.

A liquid ejecting apparatus of an aspect of the invention includes: a liquid ejecting head ejecting liquid from nozzles thereof formed on a nozzle formation surface onto a target that is being transported; and a rotating member that is rotatably disposed opposite the nozzle formation surface, the rotating member having a supporting surface for supporting the target and an absorbing surface for absorbing the liquid ejected from the nozzle. The rotating member has such a configuration that a first maximum length from a rotational center to the absorbing surface is longer than a second maximum length from the rotational center to the supporting surface.

In the liquid ejecting apparatus according to another aspect of the invention, the first maximum length in a direction perpendicular to the nozzle formation surface, when the absorbing surface is facing the nozzle formation surface, is longer than the second maximum length in the direction perpendicular to the nozzle formation surface, when the supporting surface is facing the nozzle formation surface.

In the aspect of the invention, the distance between the absorbing surface of the rotating member and the nozzle formation surface, when the rotating member is turned to cause the absorbing surface thereof to face the nozzle formation surface, is smaller than that between the supporting surface of the rotating member and the nozzle formation surface, when the rotating member is turned to cause the supporting surface thereof to face the nozzle formation surface. In other words, the distance between the rotating member and the nozzle formation surface is smaller when the rotating member is in such a position as to receive and absorb using the absorbing surface thereof the liquid discharged from the nozzles during flushing, than when the rotating member is in such a position as to support the target with the supporting surface thereof. Thus, it is possible to reduce scattering of the liquid discharged from the nozzles during flushing.

In the liquid ejecting apparatus according to another aspect of the invention, a length from the rotational center to the nozzle formation surface in the direction perpendicular to the nozzle formation surface is constant.

In the liquid ejecting apparatus according to another aspect of the invention, the absorbing surface may form an arc with the center thereof at the rotational center of the rotating member.

In this aspect, as the distance between the absorbing surface and the nozzle formation surface remains constant, it is possible to accommodate small variations in the turning angle of the rotating member, if any, when the rotating member is turned to cause the absorbing surface thereof to face the nozzle formation surface.

In the liquid ejecting apparatus according to a further aspect of the invention, a plurality of the absorbing surfaces and supporting surfaces may be alternately arranged on the rotating member in the rotational direction of the rotating member.

This configuration can reduce the time needed for the rotating member to be turned between the position where the absorbing surface is facing the nozzle formation surface and the position where the supporting surface is facing the nozzle formation surface.

BRIEF DESCRIPTION OF THE DRAWINGS

The invention will be described with reference to the accompanying drawings, wherein like numbers reference like elements.

DESCRIPTION OF EXEMPLARY EMBODIMENTS

One embodiment of a liquid ejecting apparatus of the invention embodied as an ink jet printer is now described with reference to the drawings.

Figure 1:
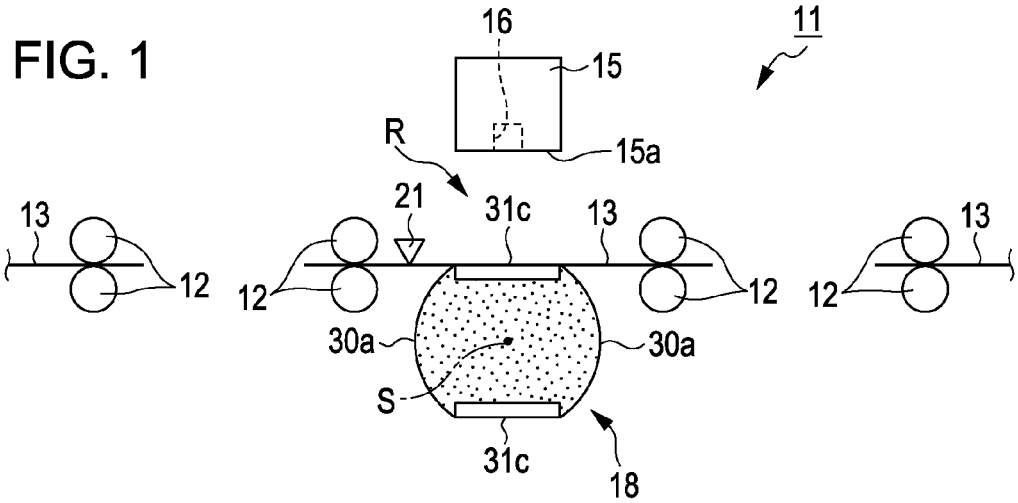
FIG. 1 is a schematic view of an ink jet printer according to one embodiment of the invention, wherein a platen member of the printer is in the printing position for supporting a recording medium.

FIG. 1 shows an ink jet printer 11 as an ink ejecting apparatus including plural pairs (e.g., four pairs in this embodiment) of upper and lower transporting rollers 12 for sequentially transporting each recording medium 13 as a target from an upstream region (left side in the view) toward a downstream region (right side in the view) with a predetermined spacing between each recording medium 13. The spacing between each pair of transporting rollers 12 is smaller than that between each recording medium 13 transported. Each pair of transporting rollers 12 is driven by a transporting motor 14 (see FIG. 5).

Directly above the transport path of the recording medium 13, a recording head 15 as a liquid ejecting head is fixedly placed for ejecting ink as liquid onto the recording medium 13 transported along the transport path. The recording head 15 horizontally extends in a direction perpendicular to the transport path of the recording medium 13. The recording head 15 is formed so that its longitudinal length is slightly longer than the width of the recording medium 13. Ink is supplied to the recording head 15 from ink cartridges (not shown). The underside of the recording head 15 is formed as a horizontal nozzle formation surface 15*a*, through which plural nozzles 16 open. Each nozzle 16 on the nozzle formation surface 15*a* is arrayed in the longitudinal direction of the recording head 15.

A platen member 18 as a rotating member is placed directly under the recording head 15, opposite the nozzle formation surface 15*a* of the recording head 15 with the transport path of the recording medium 13 therebetween, and supports the recording medium 13 transported along the transport path. The platen member 18 is formed so as to extend along the longitudinal direction of the recording head 15 and to be slightly longer in length than the recording head 15. The platen member 18 can be drivingly rotated in both directions by a rotary motor 19 (see FIG. 5) about the central axis S of the platen member 18. In other words, the central axis S is the rotational center of the platen member 18 in this embodiment.

There is provided on the output shaft (not shown) of the rotary motor 19, a rotary encoder 20 (see FIG. 5) for detecting the turning angle of the platen member 18. A recording medium end sensor 21 for detecting the anterior end of the recording medium 13 transported is also provided slightly upstream (left side in FIG. 1) of a printing area R which is the area between the platen member 18 and the recording head 15 in the transport path of the recording medium 13. Meanwhile, spacing between each recording medium 13 transported along the transport path is formed so as to be wider than the printing area R.

There is also provided in the recording head 15, piezoelectric elements 17 (see FIG. 5) that cause respective nozzles 16 to eject ink. Driving each piezoelectric element 17 (see FIG. 5) causes the ink in the respective ink cartridges (not shown) to be supplied to the recording head 15, then the ink is ejected from each nozzle 16 of the recording head 15 onto the recording medium 13 being fed on the platen member 18, so that the printing is performed.

The configuration of the platen member 18 is now described in detail.

Figure 3:
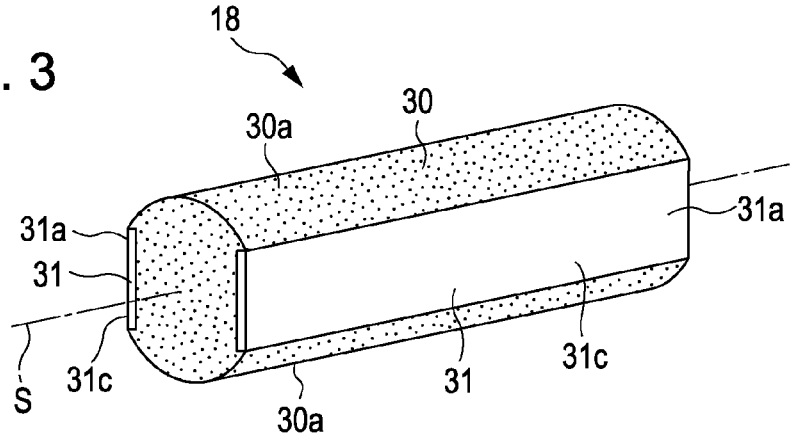
FIG. 3 is a perspective view of the platen member of the printer in FIGS. 1 and 2.
Figure 4A:
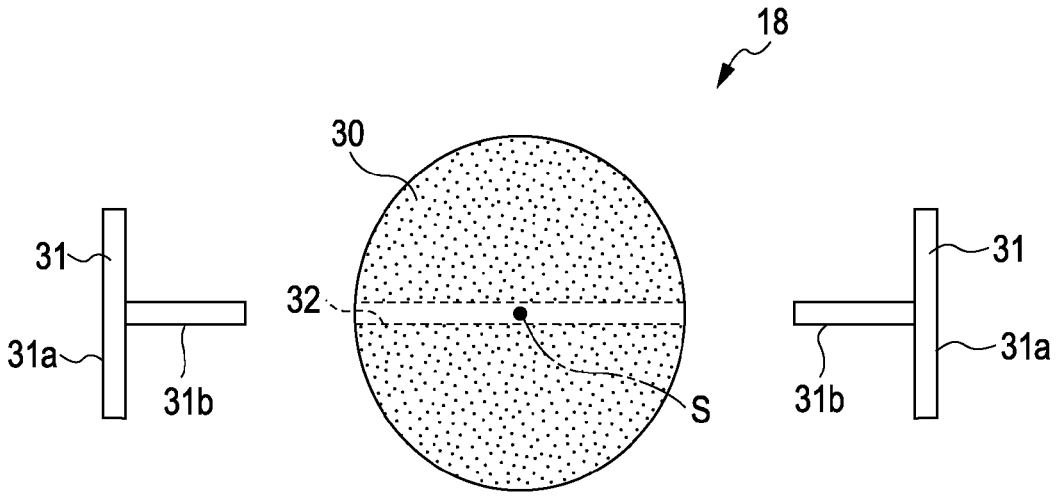
FIG. 4A is an exploded view of the platen member.

As shown in FIGS. 3 and 4A, the platen member 18 includes an ink absorbing material 30 (liquid absorbing material), as an absorbing portion, made of a flexible porous member generally cylindrical in shape, and a pair of support members 31 (supporting surface forming members) attached to the ink absorbing material 30 by sandwiching the ink absorbing material 30.

Each support member 31 is made of rigid synthetic resin, and includes a rectangular plate-like supporting portion 31*a* having the same longitudinal length as the ink absorbing material 30 and a rectangular plate-like projection 31*b* provided on the inner surface of the supporting portion 31*a*. The projection 31*b* extends along the longitudinal direction of the supporting portion 31*a* at the lateral center on the inner surface of the supporting portion 31*a* and is joined to the supporting portion 31*a* at right angles. In this embodiment, both longitudinal ends of the projection 31*b* do not extend as far as the longitudinal ends of the supporting portion 31*a*. That is, the longitudinal length of the projection 31*b* is slightly shorter than that of the supporting portion 31*a* at both ends of the supporting member 31.

Figure 4B:
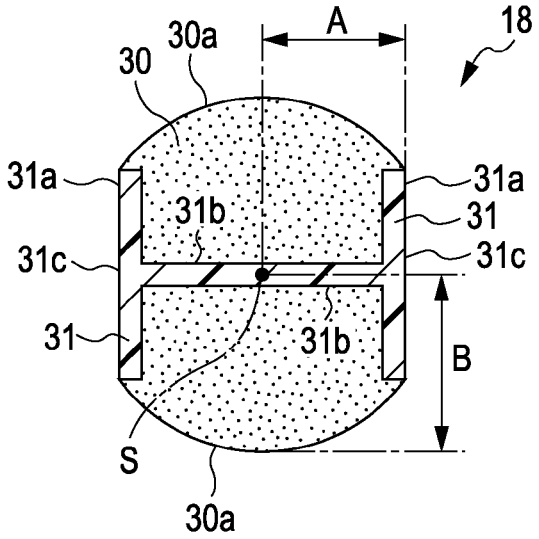
FIG. 4B is a sectional view of the platen member.

Meanwhile, the ink absorbing material 30 is generally circular in shape when viewed from the longitudinal direction thereof. On the peripheral surface (face) of the ink absorbing material 30, a through-hole 32 extending along the central axis S is formed so as to correspond to the projections 31*b* of the supporting members 31. As shown in FIG. 4B, the projection 31*b* of each supporting member 31 is inserted from each end of the through-hole 32 of the ink absorbing material 30, and then, the tip ends of the projections 31*b* of the supporting members 31 are joined together in the through-hole 32 to allow both supporting members 31 to be attached to the ink absorbing material 30, so that the platen member 18 is formed.

At this point, the supporting portion 31*a* of each supporting member 31 is embedded into the ink absorbing material 30 by an amount equal to its thickness so that the outer surface of each supporting portion 31*a* is substantially flush with the peripheral surface of the ink absorbing material 30. The outer surface of each supporting portion 31*a* functions as a supporting surface 31*c* to support each printing medium 13, which is transported along the transport path, in the printing area R. The supporting surface 31*c* forms a flat surface.

The area not covered by each supporting member 31 on the peripheral surface (face) of the ink absorbing material 30, that is, the area between the supporting surfaces 31*c* on the peripheral surface of the ink absorbing material 30, functions as an absorbing surface 30*a* for receiving and absorbing the ink ejected from each nozzle 16 of the recording head 15. Thus, the peripheral surface of the platen member 18 has two support surfaces 31*c* and two absorbing surfaces 30*a* disposed alternately in the rotational direction (peripheral direction) of the platen member 18.

As shown in FIG. 4B, when viewed from the longitudinal direction of the platen member 18 with the absorbing surfaces 30*a* being at the top and bottom of the platen member 18, the supporting surfaces 31*c* are located on the right and left respectively, and the platen member 18 now takes a symmetric geometry in both the lengthwise and crosswise. Each absorbing surface 30*a* forms an arc with its center at the central axis S.

Figure 2:
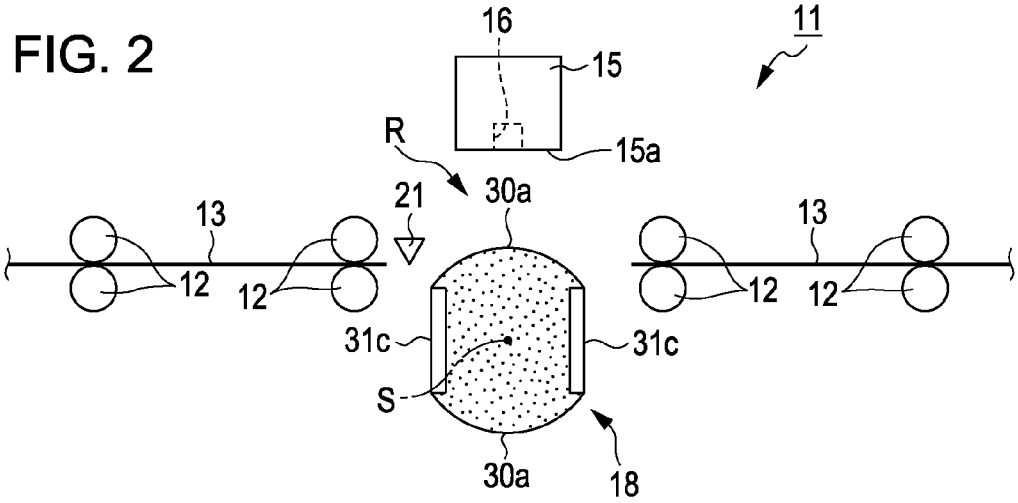
FIG. 2 is a schematic view of an ink jet printer according to one embodiment of the invention, wherein the platen member of the printer is in the flushing position for receiving ink discharged during flushing.

As shown in FIGS. 1, 2 and 4B, the platen member 18 has such a configuration that the length B from the rotational axis S to the apex of the absorbing surface 30*a* (maximum length from the rotational axis S to the absorbing surface 30*a*) in the direction perpendicular (vertical in this embodiment) to the nozzle formation surface 15*a*, when the absorbing surface 30*a* is facing the nozzle formation surface 15*a* of the recording head 15, is longer than the length A (maximum length) from the rotational axis S to the supporting surface 31*c* in the direction perpendicular to the nozzle formation surface 15*a*, when the supporting surface 31*c* is facing the nozzle formation surface 15*a*.

In this embodiment, because the supporting surface 31*c* is a flat surface, the length from the rotational axis S to any positions on the supporting surface 31*c* in the direction perpendicular to the nozzle formation surface 15*a* remains constant when the supporting surface 31*c* is facing the nozzle formation surface 15*a*.

Figure 5:
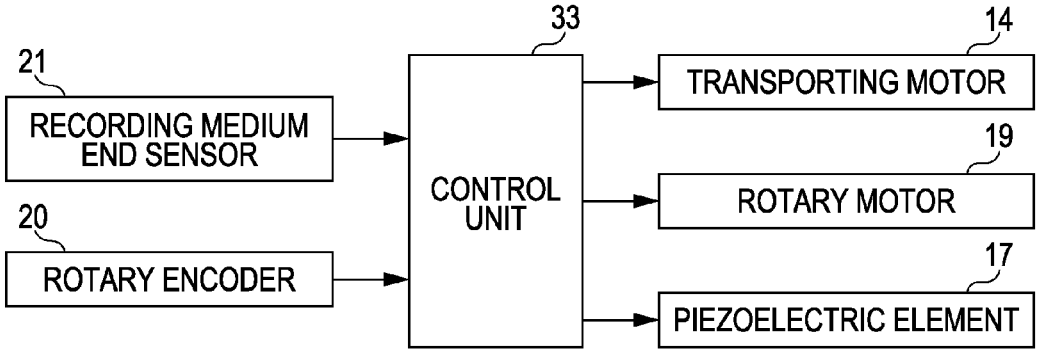
FIG. 5 is a block diagram showing an electrical configuration of an ink jet printer according to one embodiment of the invention.

As shown in FIG. 5, the ink jet printer 11 includes a control unit 33 for general control of the whole apparatus. The recording medium end sensor 21 and rotary encoder 20 are each connected electrically to the input side interface (not shown) of the control unit 33. The transporting motor 14, piezoelectric element 17 and rotary motor 19 are each connected electrically to the output side interface (not shown) of the control unit 33. The control unit 33 is configured to individually control the driving of the transporting motor 14, piezoelectric element 17 and rotary motor 19 on the basis of signals transmitted from the medium end sensor 21 and the rotary encoder 20.

In the following, the operation of the ink jet printer 11 is described.

For performing printing on the recording medium 13, firstly, the rotary motor 19 is driven to cause the platen member 18 to turn so that the supporting surface 31*c* faces the nozzle formation surface 15*a* of the recording head 15, thereby the platen member 18 is set to be in the printing position (the position shown in FIG. 1) which is the position taken during printing. Next, the transporting motors 14 are driven such that plural recording media 13 are sequentially transported along the transport path. The recording medium end sensor 21 detects the anterior end of each recording medium 13 transported, and the piezoelectric element 17 is driven when the recording medium 13 reaches the printing area R.

At this point, ink is ejected from each nozzle 16 of the recording head 15 toward the recording medium 13 supportedly transported on the supporting surface 31*c* of the platen member 18, such that the printing on the recording medium 13 is performed. In this way, each recording medium 13 is sequentially printed while being transported from the upstream region toward the downstream region.

While printing on each recording medium 13, the ink in the nozzle 16, which is not used for the printing, may become dehydrated and viscous, thus the ink may not be ejected satisfactorily from the above nozzle when needed later. For this reason, it is commonly required to perform flushing of ink on a regular basis so as to cause all nozzles 16 to discharge ink during printing, independent of the printing operations, for reducing the viscosity of the ink in each nozzle 16.

In this embodiment, flushing is performed in the interval between printing operations of each recording medium 13. In other words, when flushing is performed, the rotary motor 19 is driven while the recording medium 13 is not in the printing area R, and the platen member 18 is turned 90° so that the absorbing surface 30*a* faces the nozzle formation surface 15*a* of the recording head 15, thereby the platen member 18 is set to be in the flushing position (the position shown in FIG. 2) which is the position taken during flushing.

When flushing is performed while the platen member 18 is in the flushing position, the flushing ink discharged from each nozzle 16 hits the absorbing surface 30*a* of the platen member 18 before being absorbed and contained in the ink absorbing material 30. The liquid ejecting head 15 and the platen member 18 doesn't move in the direction perpendicular to the nozzle formation surface 15*a*. So, the distance between the nozzle formation surface 15*a* and the central axis S is constant. The platen member 18 has such a configuration that the length B from the rotational axis S to the apex of the absorbing surface 30*a* is longer than the length A from the rotational axis S to the supporting surface 31*c*, the distance from the absorbing surface 30*a* of the platen member 18 to the nozzle formation surface 15*a* is smaller in the flushing position than the distance from the recording medium 13 supported on the supporting surface 31*c* of the platen member 18 in the printing position to the nozzle formation surface 15*a*.

Thus, the smaller distance between the platen member 18 and the nozzle formation surface 15*a* allows reduction of scattering of the flushing ink as mist discharged from each nozzle 16. This results in reduced contamination of the inside of the ink jet printer 11 by the flushing ink, as well as effective collection of the flushing ink by the ink absorbing material 30.

When flushing is completed, the platen member 18 is quickly turned another 90° by driving of the rotary motor 19 before the next recording medium 13 enters the printing area R, such that the platen member 18 is turned from the flushing position to the printing position. Thereafter printing operation of each recording medium 13 will continue to be performed.

The following advantages can be obtained according to the embodiments described above in detail.

(1) The length B from the central axis S to the absorbing surface 30*a* of the platen member 18 is longer than the length A from the central axis S to the supporting surface 31*c* of the platen member 18 in the direction perpendicular to the nozzle formation surface 15*a*. Therefore, the distance between the platen member 18 and the nozzle formation surface 15*a* is smaller in the flushing position than in the printing position. Therefore, scattering of the flushing ink as mist discharged from each nozzle 16 during flushing can be reduced. This results in reduced contamination of the inside of the ink jet printer 11 by the flushing ink.

(2) The absorbing surface 30*a* of the platen member 18 forms an arc with its center at the central axis S of the platen member 18. Thus, as the distance between the absorbing surface 30*a* and the nozzle formation surface 15*a* remains constant, it is possible to accommodate small variations in the turning angle of the platen member 18, if any, when the platen member 18 is turned from the printing position to the flushing position. Therefore, it is not necessary to achieve such a high precision in the turning angle when the platen member 18 is turned from the printing position to the flushing position.

(3) The peripheral surface of the platen member 18 has two absorbing surfaces 30*a* and two supporting surfaces 31*c* alternately disposed in the rotational direction of the platen member 18. In this way, the turning angle will be smaller when the platen member 18 is turned between the printing position and flushing position, than in the case where the peripheral surface of the platen member 18 has one absorbing surface 30*a* and one supporting surface 31*c* along the rotational direction of the platen member 18. This enables reduction of the time needed to turn the platen member 18 between the printing position and flushing position.

(4) The configuration of the platen member 18 can be simple because the absorbing surface 30*a* is formed from part of the ink absorbing material 30, and the supporting surface 31*c* is formed from part of the supporting member 31 attached to the ink absorbing material 30.

(5) The flat surface of the supporting surface 31*c* of the platen member enables stable support of the recording medium 13 on the supporting surface 31*c*.

Other Embodiments

The above embodiments may be modified as follows.

Figure 6:
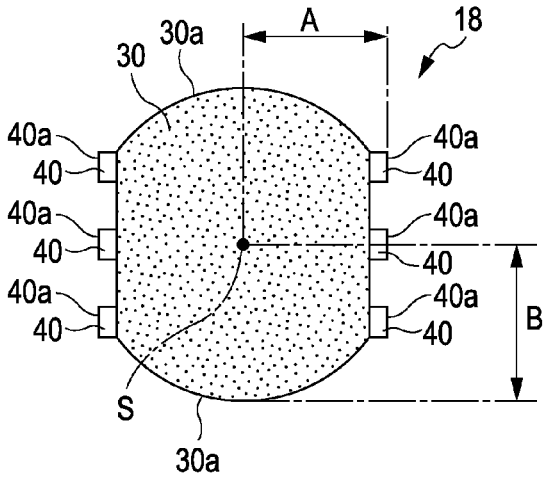
FIG. 6 is an elevational view of a platen member according to another embodiment of the invention.

As shown in FIG. 6, an ink absorbing material 30 of a platen member 18 may be provided with plural (three pairs in the figure) ribs 40, and the tip end surface of each rib 40 may define a supporting surface 40*a*. The length B is also longer than the length A as in the case of the above embodiment. The surface area on the ink absorbing material 30 where each rib 40 is disposed may be formed by cutting part of the ink absorbing material 30 to provide a flat surface.

Figure 7:
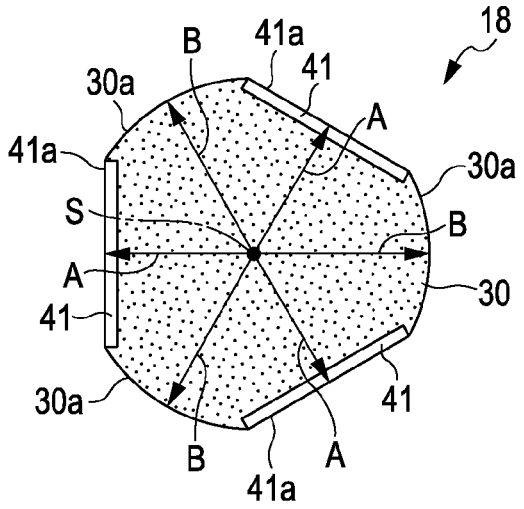
FIG. 7 is an elevational view of a platen member according to still another embodiment of the invention.

As shown in FIG. 7, the peripheral surface of a platen member 18 may have three absorbing surfaces 30*a* and three supporting surfaces 41*a* alternately disposed in the rotational direction of the platen member 18. The supporting surface 41*a* is formed from the outer surface of a supporting plate 41 made of metal or rigid synthetic resin, flushly embedded into the peripheral surface of the platen member 18. The surface area of an ink absorbing material 30 where each supporting plate 41 is attached is formed by cutting part of the ink absorbing material 30 to provide a flat surface. The length B from the central axis S to the apex of the absorbing surface 30*a* is longer than the length A from the central axis S to the supporting surface 41*a*.

Figure 8:
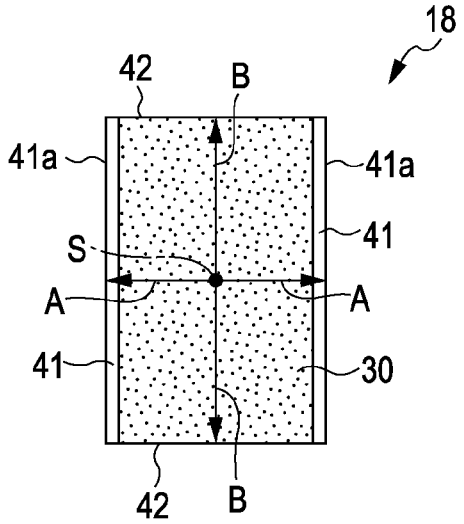
FIG. 8 is an elevational view of a platen member according to still another embodiment of the invention.

As shown in FIG. 8, a platen member 18 may be formed so as to be rectangular in shape when viewed from the longitudinal direction thereof. In this embodiment, a supporting surface 41*a* is defined by the outer surface of a supporting plate 41 attached to two opposing longitudinal surfaces of an ink absorbing material 30. The surface area where each supporting plate 41 is attached and an absorbing surface 42 of the ink absorbing material 30 are formed by cutting part of the ink absorbing material 30 to provide respective flat surfaces. The length B from the central axis S to the absorbing surface 42 is longer than the length A from the central axis S to the supporting surface 41*a*.

The platen member 18 shown in FIG. 8 may be formed so as to have a parallelogram, trapezoid or diamond shape when viewed from the longitudinal direction thereof.

Figure 9:
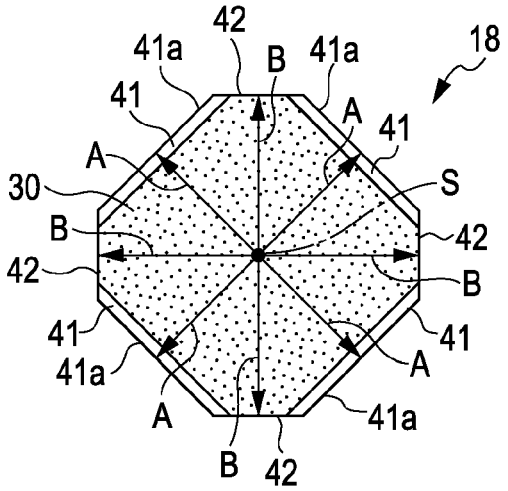
FIG. 9 is an elevational view of a platen member according to still another embodiment of the invention.

As shown in FIG. 9, a platen member 18 may be formed so as to have an octagonal shape when viewed from the longitudinal direction thereof, and the peripheral surface of the platen member 18 may have four absorbing surfaces 42 and four supporting surfaces 41*a* alternately disposed in the rotational direction of the platen member 18. In this embodiment, the supporting surface 41*a* is defined by the outer surface of a supporting plate 41 attached to the peripheral surface of an ink absorbing material 30. The surface area where each supporting plate 41 is attached and the absorbing surface 42 of the ink absorbing material 30 are formed by cutting part of the ink absorbing material 30 to provide respective flat surfaces. The length B from the central axis S to the absorbing surface 42 is longer than the length A from the central axis S to the supporting surface 41*a*.

Figure 10:
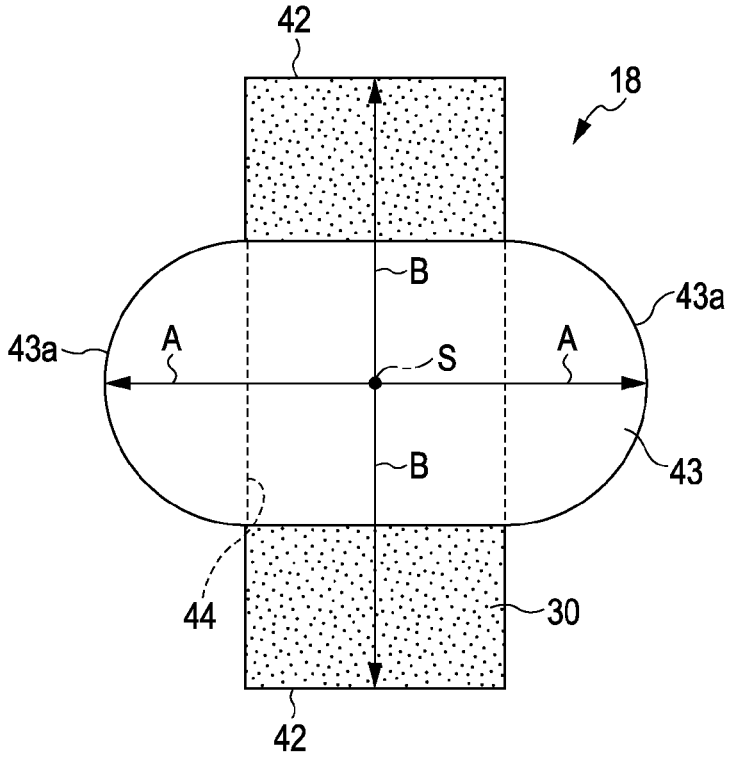
FIG. 10 is an elevational view of a platen member according to still another embodiment of the invention.

As shown in FIG. 10, a platen member 18 may include a generally cylindrical base member 43 made of rigid synthetic resin and an ink absorbing material 30 filled into a through-hole 44 formed along the minor axis of the base member 43. In this embodiment, the ink absorbing material 30 is formed so as to have a rectangular shape when viewed from the longitudinal direction thereof, and two opposing surfaces on the short sides define absorbing surfaces 42. Two surfaces on the major axis sides of the base member 43 are formed as arc surfaces, and supporting surfaces 43*a* are defined by the arc surfaces. The length B from the central axis S to the absorbing surface 42 is longer than the length A from the central axis S to the supporting surface 43*a*.

Figure 11:
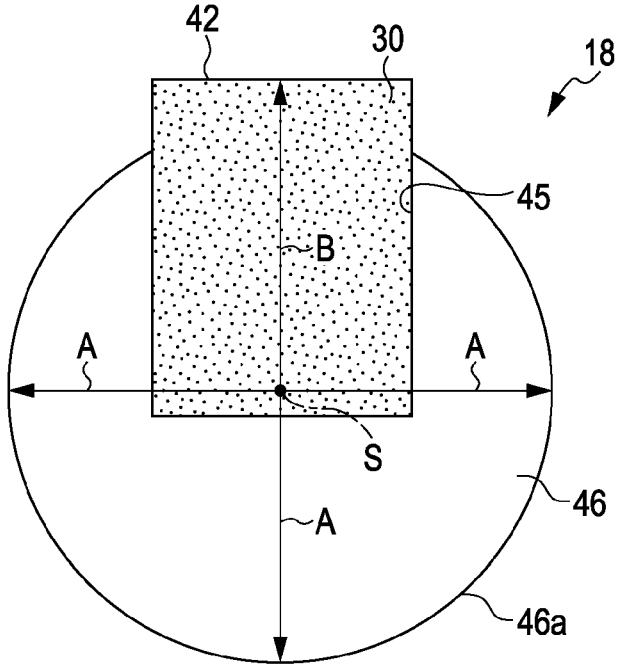
FIG. 11 is an elevational view of a platen member according to still another embodiment of the invention.

As shown in FIG. 11, a platen member 18 may include a cylindrical base member 46 made of rigid synthetic resin and an ink absorbing material 30 filled into a rectangular groove 45 longitudinally formed on part of the peripheral surface of the base member 46. In this embodiment, the ink absorbing material 30 is formed so as to have a rectangular shape when viewed from the longitudinal direction thereof, and the tip end surface thereof defines an absorbing surface 42. A supporting surface 46*a* is defined by an arc surface formed on the part of the peripheral surface of the base member 46 other than the rectangular groove 45. The length B from the central axis S to the absorbing surface 42 is larger than the length A from the central axis S to the supporting surface 46*a*.

The platen member 18 may be modified to have any number (for example, 5 or more) of the absorbing surface 30*a* and supporting surface 31*c* and to have any shape (for example, circular, oval or polygonal) when viewed from the longitudinal direction thereof, as long as it has at least one absorbing surface 30*a* and supporting surface 31*c* each on the peripheral surface thereof. However, it is required that the length B from the central axis S to the absorbing surface 30*a* should be longer than the length A from the central axis S to the supporting surface 31*c*.

The platen member 18 may be formed so as to have no supporting member 31, and part of the peripheral surface of the ink absorbing material 30 may be cut out to provide a flat surface and then the surface may be treated hard to form a supporting surface.

The platen member 18 may be configured to turn within the range of the absorbing surface 30*a* during flushing. When the platen member 18 is turned between the printing position and flushing position, the platen member 18 may be configured to rotate back and forth such that one of the absorbing surfaces 30*a* and one of the supporting surfaces 31*c* that are adjacent alternately face the nozzle formation surface 15*a*.

The central axis S and the rotational center of the platen member 18 may not always be the same. That means the platen member 18 may be rotated about the rotational center disposed away from and being parallel to the central axis S.

Although the above embodiments have been described with respect to an ink jet printer 11, the aspects of the invention can also be employed in a liquid ejecting apparatus that ejects and/or discharges any liquid other than ink. These aspects are possible to be applied to various kinds of liquid ejecting apparatuses having, for example, a liquid ejecting head which discharges minute droplets. Herein, the term "droplet" is used to describe the state of liquid discharged from the above-mentioned liquid ejecting apparatus and include one having a trailing end of grain, eye-drop or thread shape. The term "liquid" referred to herein may be any material that the liquid ejecting apparatus can eject. For example, it may be a substance in a liquid phase, including a liquid body with high or low viscosity, and a fluid such as sol, gel, other inorganic solvent, organic solvent, solution, liquid resin and liquid metal (molten metal). It may not only include liquid as a state of a substance, but also particles of functional material, made of solid matter such as pigment or metal particles, dissolved, dispersed or mixed in solvent. Typical examples of liquid include the ink described in the above embodiment and liquid crystals. The term "ink" referred to herein may include common aqueous ink and oil-based ink, as well as various liquid compositions such as gel ink and hot melt ink. Specific examples of a liquid ejecting apparatus may include a liquid ejecting apparatus for ejecting the liquid including a dispersion or solution of materials such as electrode materials or color materials used for manufacturing liquid crystal displays, EL (electroluminescence) displays, surface-emitting displays, color filters and so on, a liquid ejecting apparatus for ejecting living organic matter used for manufacturing biochips, and a liquid ejecting apparatus, printing apparatus or micro dispenser used as a precision pipette for ejecting samples in liquid state. Other examples may include a liquid ejecting apparatus for pinpoint ejection of lubricant to precision instruments such as watches or cameras, a liquid ejecting apparatus for ejecting transparent liquid resin such as ultraviolet curing resin on substrates for forming minute semispherical lenses (optical lenses) used for optical communication elements, and a liquid ejecting apparatus for ejecting etchant such as acid or alkali for etching substrates. The aspects of the invention can be applied in any one of the above liquid ejecting apparatuses.

The following summarizes some of the technical ideas to be understood from the above embodiments.

1. A liquid ejecting apparatus according to an aspect of the invention includes a rotating member configured to have an absorbing portion formed from a liquid absorbing material capable of absorbing the above-mentioned liquid, and a supporting surface defined by a surface of a supporting surface forming member attached to the liquid absorbing material.

This configuration enables the rotating member to be simplified.

2. The liquid ejecting apparatus according to another aspect of the invention includes the rotating member having the supporting surface formed as a flat surface.

This configuration enables the supporting surface to stably support the target.

What is claimed is:

1. A liquid ejecting apparatus comprising:

a liquid ejecting head ejecting liquid from nozzles thereof formed on a nozzle formation surface onto a target that is being transported; and a rotating member rotatably disposed opposite the nozzle formation surface, the rotating member having a supporting surface for supporting the target and an absorbing surface for absorbing the liquid ejected from the nozzles, and a first maximum length from a rotational center to the absorbing surface in a direction perpendicular to the nozzle formation surface, when the absorbing surface is facing the nozzle formation surface, is longer than a second maximum length from the rotational center to the supporting surface in the direction perpendicular to the nozzle formation surface, when the supporting surface is facing the nozzle formation surface, wherein the first maximum length in the direction perpendicular to the nozzle formation surface when the absorbing surface is facing the nozzle formation surface is shorter than a distance from the rotational center to the nozzle formation surface, wherein a distance between the absorbing surface and the nozzle formation surface when the liquid is ejected from the nozzles toward the absorbing surface not in contact with the nozzle surface is shorter than a distance between the supporting surface and the nozzle formation surface when the liquid is ejected onto the target.

2. The liquid ejecting apparatus according to claim 1, wherein a length from the rotational center to the nozzle formation surface in the direction perpendicular to the nozzle formation surface is constant.

3. The liquid ejecting apparatus according to claim 1, wherein the absorbing surface forms an arc with the center thereof at the rotational center of the rotating member.

4. The liquid ejecting apparatus according to claim 1, wherein a plurality of the absorbing surfaces and supporting surfaces are alternately arranged on the rotating member in the rotational direction thereof.

5. The liquid ejecting apparatus according to claim 1, further comprising a sensor that detects the target being transported, and wherein the rotating member is rotatable and configured such that the supporting surface or the absorbing surface is located opposing the nozzle formation surface based on a detection result of the sensor.

6. The liquid ejecting apparatus according to claim 1, wherein the rotating member includes a liquid absorbing material and a support member having the supporting surface thereon, the support member being attached to the liquid absorbing material, and wherein an area on a peripheral surface of the ink absorbing material is not covered by the support member so as to act as the absorbing surface.

7. The liquid ejecting apparatus according to claim 1, wherein the support member is embedded into the liquid absorbing material.

8. A liquid ejecting apparatus comprising:

a liquid ejecting head ejecting liquid from nozzles thereof formed on a nozzle formation surface onto a target that is being transported; and a rotating member rotatably disposed opposite the nozzle formation surface, the rotating member having a supporting surface for supporting the target and an absorbing surface for absorbing the liquid ejected from the nozzles, and a distance from the nozzle formation surface to the absorbing surface in a direction perpendicular to the nozzle formation surface, when the absorbing surface is facing the nozzle formation surface, is shorter than a distance from the nozzle formation surface to the supporting surface in the direction perpendicular to the nozzle formation surface, when the supporting surface is facing the nozzle formation surface, wherein the liquid is ejected from all of the nozzles toward the absorbing surface in a state that the absorbing surface is facing the nozzle formation surface before being absorbed, wherein a distance between the absorbing surface and the nozzle formation surface when the liquid is ejected from the nozzles toward the absorbing surface not in contact with the nozzle surface is shorter than a distance between the supporting surface and the nozzle formation surface when the liquid is ejected onto the target.

* * * * *